United States Patent [19]

Ferrante

[11] Patent Number: 4,663,540

[45] Date of Patent: May 5, 1987

[54] MAGNETIC FUEL TANK SAFETY SWITCH

[76] Inventor: Felix Ferrante, 4515 N. Front St., Philadelphia, Pa. 19140

[21] Appl. No.: 866,886

[22] Filed: May 23, 1986

Related U.S. Application Data

[63] Continuation-in-part of Ser. No. 777,726, Sep. 19, 1985.

[51] Int. Cl.[4] ..... H01H 35/18; H01H 29/14

[52] U.S. Cl. ..... 307/118; 200/230

[58] Field of Search ..... 307/112–116, 307/118; 200/60.2, 190, 230

[56] References Cited

U.S. PATENT DOCUMENTS

| | | | |
|---|---|---|---|
| 3,184,566 | 5/1965 | Kleinpeter | 200/190 |
| 3,823,328 | 7/1974 | Barton et al. | 307/118 |
| 3,848,616 | 11/1974 | Sanner | 307/118 |
| 4,087,706 | 5/1978 | Koester et al. | 200/190 |
| 4,418,712 | 12/1983 | Braley | 307/118 X |
| 4,605,038 | 8/1986 | Tchitdjian | 307/118 X |

*Primary Examiner*—Vit W. Miska

*Attorney, Agent, or Firm*—Steele, Gould & Fried

[57] ABSTRACT

An electric control element, and more particularly a control that is responsive to a liquid level indicator and is operative to prevent a fuel tank from inadvertently running dry.

10 Claims, 8 Drawing Figures

MAGNETIC FUEL TANK SAFETY SWITCH

CROSS REFERENCE TO RELATED APPLICATION

This is a continuation-in-part of Ser. No. 777,726, filed Sept. 19, 1985.

BACKGROUND OF THE INVENTION

1. Field of the Invention

This invention relates generally to an electric control element, and more particularly to a control that is responsive to a liquid level indicator and is operative to prevent a fuel tank from inadvertently running dry.

2. Description of the Prior Art

It is known to mount visual liquid level indicators on liquid storage tanks such as storage tanks for fuel oil. The indicator typically includes a float on a linkage mechanically connected to a visible marker element located outside the tank. The level indicator linkage may extend, for example, through an opening in the top of the tank where it is received in a downwardly-oriented transparent bell jar that is threadably engaged to the tank opening, for example with a threaded neck formed at the opening. The bell jar may bear graduation markings in gallons or proportions and the position of the visible element in the jar corresponds to the position of the float in the tank. The indicator provides a readily visible measure of the amount of fuel or other fluid within the tank.

In the case of fuel oil tanks for heaters and the like it is most undesirable to allow the heating oil supply stored in a tank to become exhausted. Running dry frequently occurs at the most inconvenient of times. Furthermore, the oil left in the bottom of a nearly-empty tank typically includes sludge and impurities which have accumulated over time. The sludge and impurities clog filters, flow lines, burners and other heater elements when drawn from the tank into the system. It also may become necessary to bleed out air from the system if the tank supply becomes exhausted. Even when not entirely clogged by sludge and the like, it may take a long time or even be impossible to return to a free-flowing condition without maintenance.

Alarm units operable to alert the user to a low-level condition are also known. Nevertheless, it is desirable to provide a control which not only warns that refilling is needed, but also at least temporarily shuts off the heater or other fuel using apparatus when the oil supply in the storage tank reaches a predetermined low value. It is also desirable to provide a control which is adapted to function with standard tank and indicator designs now in service, and with minimal installation effort. It is further desirable to provide a control with a manual override function such that, if necessary, the heater can still be operated after the low level cutoff, if desired, even until the oil supply is exhausted, and to automatically reset from an override condition when the tank is refilled.

SUMMARY OF THE INVENTION

It is an object of the present invention to provide an electric control which halts the operation of a liquid-level-sensitive device at a predetermined low liquid level setpoint in a storage tank.

It is another object of the invention to provide a control which can be overridden if necessary to allow continued operation of the device below the low setpoint.

It is a further object o the invention to automatically reset a cutoff-override condition when the tank is refilled.

It is yet another object of the invention to provide a control which is easily installed in conventional tanks and is responsive to conventional indicator structures without substantial modification.

It is also an object of the invention to provide a control having protected electrical connections to prevent sparks.

It is still another object of the invention to provide a control which is safe, simple and reliable.

These and other objects are accomplished by a control for a device wherein the control is responsive to a level indicator including a magnet movable over a range according to the liquid level in a tank. A normally-closed first switch is positioned adjacent a path of the indicator and is operated by magnetic attraction with the indicator part at a first position within its range of movement to open a control circuit and thereby cease operation of the device.

A normally-open second switch is manually movable to a closed position at which it closes the control circuit and remains stable even at low level conditions. The first and second switches are connected in parallel with one another and in series with the controlled load, whereby the second switch is manually operable to bypass the first switch and close the circuit, permitting operation of the load device. Upon refilling of the tank, the magnetic indicator moves toward its "full" indication, and at or above the setpoint of the first switch, magnetic repulsion with the indicator causes the second switch to return to its normally open condition.

The first and second switches preferably include pivotally mounted lever arms with magnets or at least magnetic poles at both ends of each of the arms. The lever arms are caused to pivot by attraction and/or repulsion between the magnet of the level indicator and their poles adjacent the indicator's path. Opposite ends of the lever arm magnets (i.e., ends spaced from the indicator) operate reed switches when the lever arms are in position. The lever arm of the first switch means is pivoted by the level indicator when it reaches a predetermined low liquid level position, opening the control circuit. Pivoting of the lever arm thereby ceases operation of the device. Should it be necessary to continue operation of the device after the first switch means has been opened, this can be accomplished by use of a manually operable push rod which pivots the lever arm of the second switch means to close the switch. This completes the control circuit and defeats the safeguard against running dry. Operation of the push rod engages the lever arm of the second switch and moves the second switch into a stable closed position. The lever arm of the second switch is reset to normal open condition by magnetic repulsion with the level indicator as the indicator moves through a second position corresponding to a predetermined rising liquid level characteristic of a refilled tank, whereupon the safeguard is again active.

The control may include magnetic reed sealed contact elements in the switch means. Alternatively, the control can include mercury switch elements with a drop of liquid mercury to make or break contact rather than magnetic reed contact elements. In one possible arrangement, a first operator lever has a magnet at its tip causing the lever to be tilted by magnetic attraction with the indicator and thereby to open a switch due to a mercury drop flowing away from sealed spaced contacts. A second mercury switch element on a second lever arm is operable to close the circuit upon pivoting of the second lever arm, on which it is mounted, by means of a manually operable push rod. The second lever arm remains stable in the "override" condition, but due to magnetic repulsion between the indicator and the second lever arm magnet the second lever arm is automatically moved out of its override position when the tank is refilled.

In the preferred embodiment, the lever arms operate magnetic reed switches placed adjacent ends of the lever arms most remote from the indicator. One or more magnets is carried on each lever arm. The first lever arm, which disconnects power at the low level, operates at an indicator position below the override position of the second lever arm.

The control is mounted in a housing which preferably includes means for attachment directly to a threaded neck leading into the tank or a conduit attached to the tank. The control structure may be supported on a hollow male threaded union which is adapted to engage an existing female thread in the tank. The control housing is adapted to receive the level indicator, for example in the form of a flat bar or disc or the like, at a free end of a rod. Preferably the housing defines a transparent level indicator compartment, sealed from wiring and switch contacts in the control, and positioning the indicator nearby the magnet-tipped levers. The housing preferably is divided into a switch compartment containing the respective switch means and an indicator compartment. The switch compartment is preferably sealed from the level indicator compartment by means of the standard downwardly-oriented bell jar covering the conventional indicator, upon which the control housing is mounted. Isolating the compartment in this manner prevents contact of vapor from the tank with any spark which might occur due to shorting, and the control is easy to install. Preferably the contact making elements, for example mercury wetted contact switches or magnetic reed switches, are fully sealed.

The control may also include an alarm to be activated when the level indicator reaches a predetermined set point such as the low level safeguard set point. The alarm alerts occupants or others to the low liquid level in the tank. The alarm can be visible or audible, or both. Alarm contacts can be added to the existing electromechanical elements, e.g., double pole switches can be used.

The control is particularly adaptable for use with an oil-fuel heating system. The low level shutoff and manual override switches for such a system should be connected in parallel with one another and in series with the thermostat of the heating system, the low level shutoff being normally closed and the manual override being normally open. The thermostat is normally connected in series with the fuel pump and/or valve.

BRIEF DESCRIPTION OF THE DRAWINGS

There is shown in the drawings embodiments which are presently preferred, it being understood however, that the invention is not limited to the precise instrumentalities and arrangements shown therein.

DESCRIPTION OF THE PREFERRED EMBODIMENTS

Figure 1:
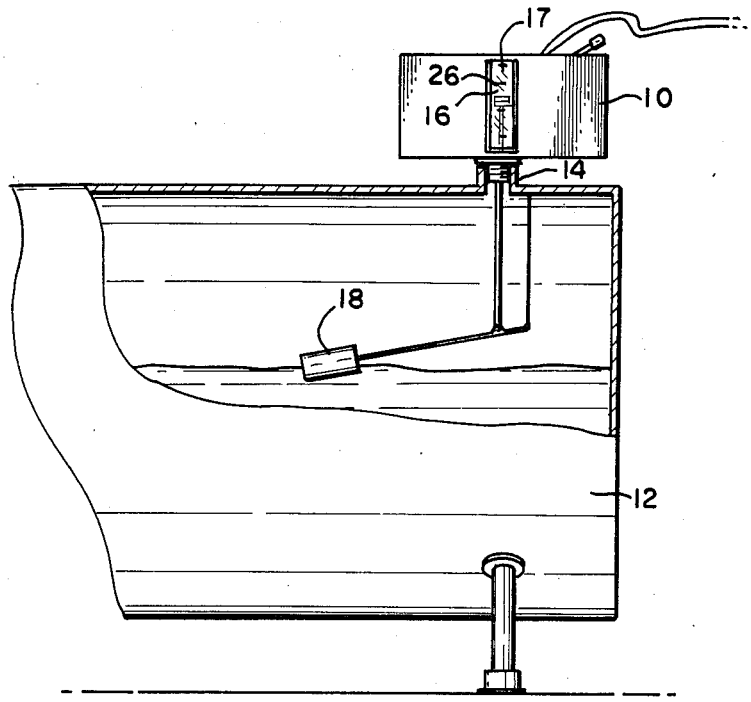
FIG. 1 is a side elevation, partially broken away, of a control according to the present invention attached to a liquid fuel storage tank.
Figure 2:
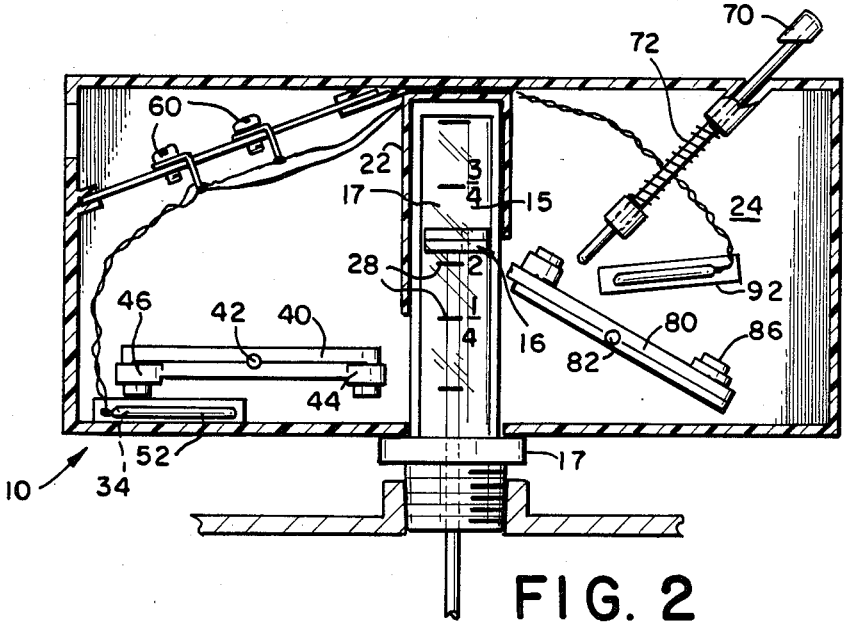
FIG. 2 is a section view of a control according to the present invention, the front housing being broken away.

Referring to FIGS. 1–2, a control unit 10 according to the invention is installed on a liquid storage tank 12. The liquid storage tank 12 may be of standard design and construction, including a neck 14 through which extends a level indicator 16. The level indicator 16 is mechanically linked to a float 18 as is known in the art such that a rise or fall in the liquid level in the tank will cause the float 18 to rise or fall. The linkage in FIG. 1 is shown in reduced size for purposes of illustration. Through the mechanical linkage the indicator 16 is caused to rise or fall vertically a proportionate distance in its range in direct response to raising or lowering of the float as the tank is filled or emptied. Typically a downwardly directed glass bell jar is connected at the bore 14 and is graduated such that the indicator 16 provides a visual indication of the quantity or proportion of fuel left in the tank.

According to the invention, indicator 16 is provided with a magnet. The magnet may replace the original indicator element (normally a disc) or may be affixed thereto. If the original element is ferrous it can simply be magnetized. The control device 10 preferably can be mounted directly over the glass bell jar on the tank, at the bore or neck 14, where device 10 interacts with the magnet of the indicator. The control includes a housing which has a central level indicator compartment 22 dimensioned for a snug fit over the jar, and at least one switch compartment 24. The level indicator compartment is preferably provided with a transparent window 26 with graduations 28 marked thereon such that the control can still function in a conventional manner as a visual level indicator, in addition to its control functions.

Two sets of magnetically-operable electrical contacts 34, i.e., magnetic reed switches, are provided in the switch compartment of the housing and are connected in parallel with one another and in series with a circuit that controls a device such as a heating unit, the operation of which affects the contents of the tank. For example, the switches may close a line from a thermostat to a heater. It is also possible that the control of the invention can respond to other similar signal sources, or control power to other devices. The control can be connected to a heater through various other control components such as timers, valves, interlocks, thermostats, etc. In any event, when the contacts of both the two reed switches 34 are open, the control interrupts a circuit, whereupon the level of fuel in tank 12 is arrested. Connection of the contacts of switches 34 can be by suitable electrical leads 44, 46, leading from the area of the tank to the area of the thermostat, heater or the like.

A tank as shown in FIG. 1 is typically of relatively large capacity, for example on the order of 100 gallons. Over time, sludge and impurities can collect in the tank and if the tank is allowed to run dry, tend to clog fuel supply lines (not shown) leading to the heater. As flow 18 approaches a predetermined low set point level at which impurities in the tank would start to flow out through fuel supply lines, magnetic indicator 16 is caused to open the circuit leading to the thermostat or other control device, thereby preventing operation. Details of control 10 are shown in FIG. 2.

Magnet 15 may be attached to indicator 16 or a magnetized original indicator or installed in place of a non-magnetized disc. Magnet 15 moves up and down over a range defined by the position of float 18 in the tank. As fuel is consumed, magnet 15 continues to drop lower and lower in jar 17. At a predetermined low level, magnet 16 operates switch lever 40, at the left in FIG. 2. Switch lever 40 is pivotally mounted around pin 42, and is provided with a magnet 44, at an end adjacent magnet 15. A second magnet 46 is at the opposite end. Magnets 44, 46 can be separate as shown, or can be the opposite poles of a single magnet. Alternatively the lever can be made of ferromagnetic material and provided with a single magnet such that the opposite ends of lever 40 define the opposite poles of a magnet due to magnetic flux being confined to the ferromagnetic material.

In the position shown in FIG. 2, switch lever 40 is tilted counterclockwise to its normal position such that magnet 46 at the end of lever 40 remote from indicator 16, is disposed against reed switch 52. The reed switch contacts are connected to terminal 60, which are in turn wired in series with the thermostat and/or the load to be controlled. When magnet 46 is in close proximity with reed switch 52, an internal magnet in reed switch 52 is displaced, thereby closing the contacts and connecting the circuit across terminals 60, 60.

When magnet 15 reaches a predetermined low level, magnetic attraction between magnet 44 and magnet 15 cause lever 40 to pivot clockwise around pin 42, drawing magnet 46 away from reed switch 52, thereby breaking the circuit between terminals 60, 60. At that point, regardless of whether the thermostat is calling for heat, the heating system will not operate and accordingly no further fuel will be used. During fuel usage at indicator positions above the low-level cutoff, override lever 80 remains as shown in FIG. 2, with magnet 84 repelled from indicator magnet 15 and magnet 86 spaced from reed switch 92.

Reed switch 52 on the low-level cutoff side can be a multiple pole or a multiple throw switch, additional contacts being provided for controlling alarm circuits and the like. Such alarms are useful in that they alert the user to the fact that the heating system has automatically ceased operation, prior to the point of uncomfortable temperatures in the space to be heated. Whether the user is made aware of the disabling of the heating system by an alarm or by a lack of heat, the opportunity is then presented for the user to manually override the control system, and continue to use whatever fuel remains in tank 12.

A manually-operable control button 70 is provided to extend outside the housing of control 10 and allow manual displacement of lever 80. Push button 70 is movable against spring bias of spring 72 to press against the second pivotable switch lever 80, likewise carried on a pin 82 and having magnets 84, 86 (or at least magnet poles) at opposite ends thereof. Push button 70 rotates lever 80 counterclockwise around pin 82, whereby magnet 86, on the end opposite from indicator 16, is moved into proximity with reed switch 92. Reed switch 92 is wired such that when magnet 86 is in proximity, the wires leading to terminal 60 are shorted, whereupon heating and fuel use resume.

Push button 70 is mounted in a track for longitudinal movement, with a biasing spring 72 tending to force push button 70 outwardly away from lever 80. Suitable stops are provided to hold push button 70 captive and to maintain the push button in position.

Magnet 44 on the automatic low-level cutoff lever 40 (left side in FIG. 2) is adapted to be attracted to magnet 16, by virtue of their respective magnetic pole orientations. Magnet 84 on the manual override side, however, is oriented to repel indicator 16. In this way, when indicator and magnet 16 rise with refilling of the tank, lever 80 is forced back to its clockwise-rotated position shown in FIG. 2, due to repulsion of magnet 84 with rising magnet/indicator 16. For correct operation in coordination with automatic shutoff lever 40, the manual override lever 80 must be positioned higher than lever 40.

The low setpoint at which lever 40 opens reed switch 42 is quite repeatable, and lever 80 need only be operated when indicator 15 is at the predetermined low position. Magnet 84 is effectively a bistable device due to repulsion between magnet 16 and magnet 84, because lever 80 cannot rotate counterclockwise except under force, from push button 70. Should pushbutton 70 be pressed when indicator 16 is above the low setpoint, the manual override condition would remain until the tank is refilled. Once rotated, the lever stays in position until, with the return of indicator 16 during filling of the tank, repulsion between magnet 16 and magnet 84 tends to again return lever 80 to the position shown in FIG. 2. Lever 80 can be balanced around pivot pin 82, or made slightly heavier on the right, to ensure against accidental override if the housing is jostled, etc.

Reed switches 52, 92 operate primarily by magnetic attraction between magnets 46, 86 and internal magnets in switches 52, 92, respectively. Accordingly, the levers 40, 80 each tend to remain stable when magnets 46, 86 are applied to reed switches 52, 92, respectively. Therefore, either operation of push button 70 or appropriate close passage of magnet indicator 16 is required in order to effect a change in state of the control.

Figure 3:
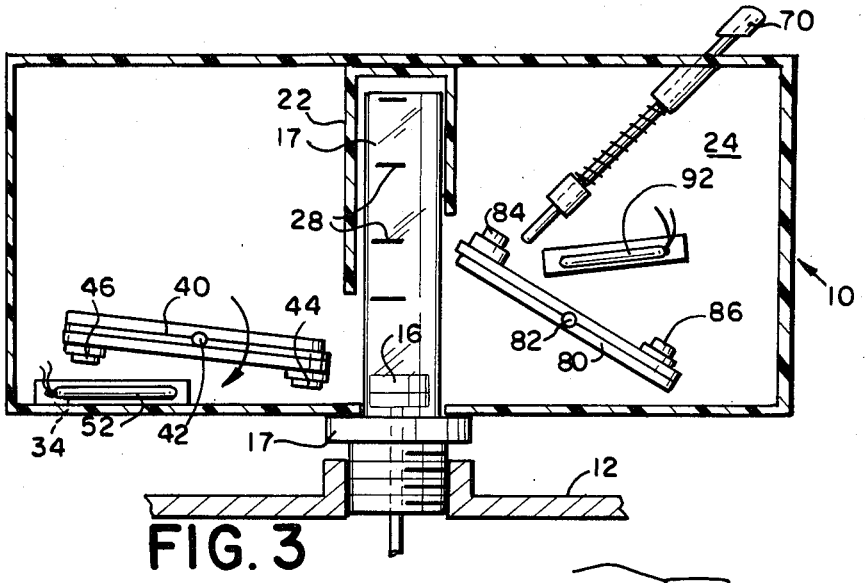
FIGS. 3 and 4 are schematic diagrams showing a control according to the invention, at different stages of operation.

FIG. 2 illustrates the condition at which the manual override is inactive and magnet/indicator 16 is above its predetermined low level set point. In FIG. 3 the magnet/indicator 16 has fallen below its predetermined low level set point. Accordingly, lever 40 has rotated clock and reed switch 52 has now been opened because magnet 46 has been lifted from reed switch 52. In the situation shown in FIG. 3, regardless of thermostat status, no heat will be provided and no fuel will be burned.

Figure 4:
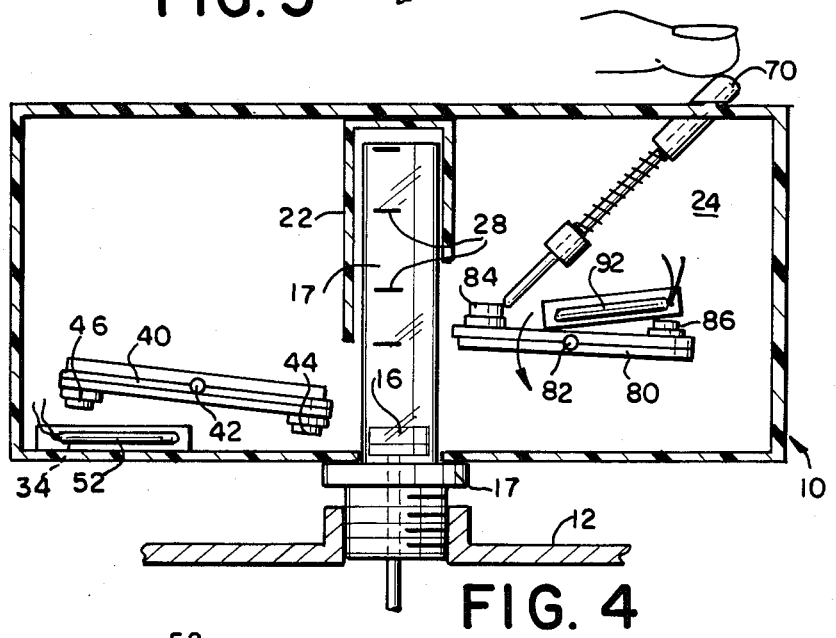

Should the user manually override the control by using push button 70 to rotate lever 80 counterclockwise, then the situation in FIG. 4 applies. In this case, although reed switch 52 is still open, reed switch 92, which is wired and parallel with reed switch 52, now closes the circuit, and fuel is provided, even to the point of running dry of the tank. Indicator 16 gets lower and lower, and has no further effect on the positions of the control levers, 40, 80 until the tank is refilled.

When the tank is refilled, lever 40 is rotated counterclockwise and lever 80 is rotated clockwise as the indicator 16 moves upwardly. Lever 40 therefore becomes latched in the position shown in FIG. 2 at which magnet 46 rests against reed switch 52. Lever 80 on the other hand is rotated such that magnet 86 is removed from reed switch 92, thereby automatically cancelling the override condition, without any affirmative action on the part of the user other than filling tank 12.

Figure 5:
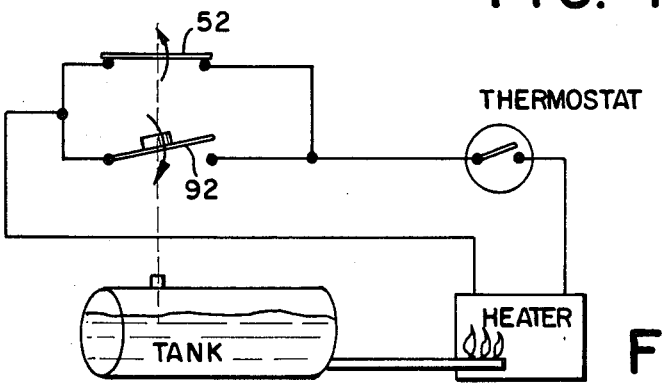
FIG. 5 is a schematic circuit diagram.

FIG. 5 shows a schematic wiring diagram. Reed switch 52, which is normally closed, allows opening and closing of thermostat 64 to control operation of heater 66. At low fuel conditions, reed switch 52 is open. In this condition, reed switch 92, which is normally open, can be closed by manual operation of push button 70. Therefore, the system is again operative.

Figure 6:
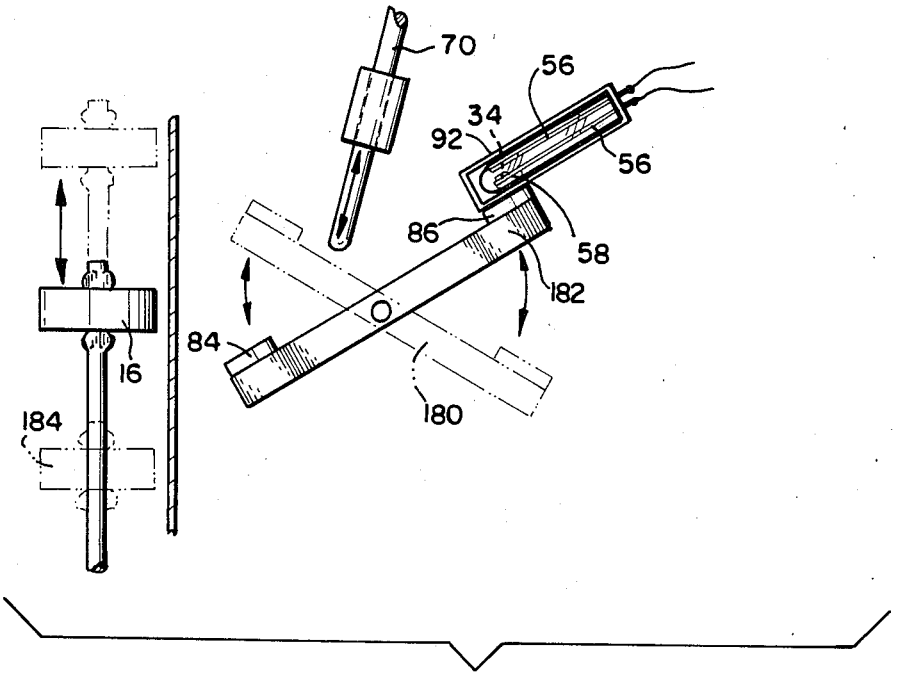
FIG. 6 is an illustration of the manual override section of the control.

In FIG. 6, an embodiment is shown in which lever 80 on the normally open side of the control is unevenly balanced. In FIG. 6, the side of lever 80 more remote from indicator 16 is just slightly longer than the side closer to indicator 16. Accordingly, lever 80 tends to rotate clockwise. When rotated clockwise as shown at 180, the weight of the lever 80 on the far side of pin 82 (i.e., at magnet 86) tends to hold the lever 80 stable in its clockwise rotated position. Similarly, in its counterclockwise rotated position as shown at 182, magnetic attraction between magnet 86 and reed switch 90 tend to keep lever 80 stable in its counterclockwise oriented position. However, in the counterclockwise position, magnetic repulsion between magnetic indicator 16 and magnet 84 will overcome the attraction between magnet 86 and reed switch 92, during refilling of the tank, indicator 16 then being moved upwardly. Repulsion of indicator/magnet 16 from magnet 84 should disable the override condition at a point somewhere above the low-level cutoff position 184.

The foregoing structure and operation allow the user to override the automatic disconnection of the heater at low fuel levels, and permit the system to reset automatically when the tank is refilled. In addition to the weighting and magnet latching techniques shown herein, other variations are also possible. In the event mercury switch elements are provided on the lever arms 40, 80, the uneven weighting that results from the movement of the mercury drop from side to side in its receptacle can provide a bistable operation. Similarly, mechanical actions in which latching elements are movable by action of magnet 16 are also possible.

Figure 7:
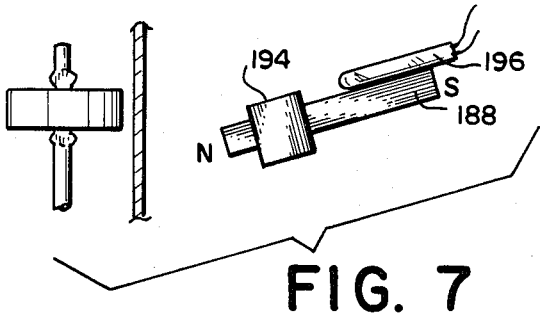
FIGS. 7 and 8 are schematic illustrations of further embodiments.
Figure 8:
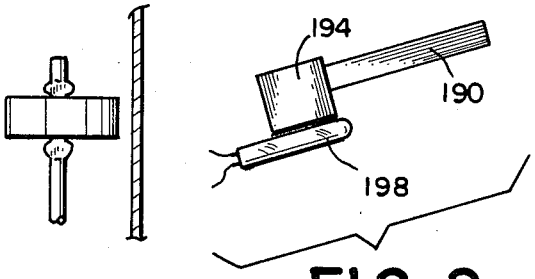

FIG. 7 shows an embodiment in which a magnet lever 188 is provided with only one magnet 194, but inasmuch as lever 188 is ferrous, opposite magnetic poles occur at the ends of the lever 188, for example for operation of a reed switch 196. Reference can be made to FIG. 6 for the internal workings of such reed switches in which reed contacts 56 are openable or closable by attached magnet 58. In FIG. 8, lever 190 likewise has only one magnet, but the magnet operates a reed switch 198 on an opposite side from the previous embodiments. An end of lever 190 counterbalances magnet 194 in FIG. 8.

The invention have been disclosed, a number of additional variations will now occur to persons skilled in the art. Reference should be made to the appended claims rather than the foregoing specification as indicating the true scope of the invention.

What is claimed is:

1. A control for closing a circuit to enable-operation of a liquid-consuming device, the control being responsive to a level indicator movable in a path over a range of positions in response to a liquid level in a tank supplying said liquid-consuming device, the control comprising:

a magnet affixed to the movable level indicator;

a first switch means having a magnet positioned adjacent the path of the indicator, the magnet of the first switch means being movable in response to the level indicator and the first switch means being operable below a predetermined low liquid level position of the indicator to open contacts in the circuit, whereby operation of the liquid consuming device is disabled; and, a second switch means operatively connected to override the first switch means and enable continued operation of the liquid consuming device, the second switch means having normally open contacts parallel to said contacts of the first switch means, the second switch means being manually movable to a closed circuit position to thereby bypass the first switch means, the second switch means having a magnet responsive to the level indicator, the second switch means being automatically returned to an open circuit position by magnetic interaction between the magnet of the second switch and the level indicator at a second position above the predetermined low liquid level.

2. The control of claim 1, wherein at least one of the first and second switch means comprises a pivotally mounted lever arm having a magnet at an end thereof positioned adjacent the path of the level indicator in the range.

3. The control of claim 2, wherein at least one of the first and second switch means is movable against contact elements for closing the circuit.

4. The control of claim 3, wherein at least one of the first and second switch means have magnetic reed switch elements for making and breaking the circuit.

5. The control of claim 1, wherein the first and second switch means each have lever arms with at least one magnet and a reed switch responsive to the magnet.

6. The control of claim 5, wherein the lever arms of the first and second switches each have two magnets, one of the two magnets being responsive to the indicator to move the lever arm, another of the two magnets being movable by the lever arm into proximity with reed switches for the first and second switch means, the reed switches being connected parallel.

7. The control of claim 6, further comprising a manually-operable push button mounted on a casing of the control and operable to pivot the lever arm of the second switch means into a closed circuit position.

8. The control of claim 7, wherein the magnets of the indicator and the second switch means have magnetic poles oriented to repel one another, whereby movement of the indicator upon filling of the tank automatically displaces the lever of the second switch means and opens contacts of the reed switch of the second switch means.

9. The control of claim 1, further comprising a housing for the switch, the housing having a receptacle for receiving a transparent jar enclosing the indicator.

10. The control of claim 8, wherein the lever of the first switch means is operable by magnetic attraction with the indicator magnet and the lever of the second means is operable by magnetic repulsion with the indicator.

* * * * *